US010233624B1

(12) United States Patent
Huang

(10) Patent No.: US 10,233,624 B1
(45) Date of Patent: Mar. 19, 2019

(54) TOILET TANK HANDLE ASSEMBLY

(71) Applicant: So-Mei Huang, Tai Ping (TW)

(72) Inventor: So-Mei Huang, Tai Ping (TW)

( * ) Notice: Subject to any disclaimer, the term of this patent is extended or adjusted under 35 U.S.C. 154(b) by 0 days.

(21) Appl. No.: 15/919,468

(22) Filed: Mar. 13, 2018

(51) Int. Cl.
*E03D 5/092* (2006.01)

(52) U.S. Cl.
CPC ..... *E03D 5/092* (2013.01)

(58) Field of Classification Search
CPC ..... E03D 5/092
USPC ..... 4/321, 413, 414
See application file for complete search history.

(56) References Cited

U.S. PATENT DOCUMENTS 7,861,330 B2 * 1/2011 Tau ..... E03D 5/092 4/249
9,469,980 B2 * 10/2016 Le ..... E03D 5/092
9,637,900 B2 * 5/2017 Yang ..... E03D 5/092
9,932,729 B1 * 4/2018 Yeh ..... E03D 5/09
2005/0273919 A1 * 12/2005 Berlovan ..... E03D 5/092 4/405

* cited by examiner

*Primary Examiner* — Tuan N Nguyen
(74) *Attorney, Agent, or Firm* — Guice Patents PLLC

(57) ABSTRACT

A toilet tank handle assembly, which includes a connecting rod group, a shaft, an internal fixed base, an external fixed base and a handle, wherein a hexagon connecting portion and a groove are set on the shaft, a hexagon hole and multiple elastic pieces are set on the head stock of the connecting rod group, stoppers are respectively set on the inner side of elastic pieces, so that the stoppers are provided to the groove if the hexagon connecting portion is inserted into the hexagon hole, to thereby achieve the purpose of quick assembly and be common to various toilet tanks.

4 Claims, 9 Drawing Sheets

TOILET TANK HANDLE ASSEMBLY

BACKGROUND OF THE INVENTION a) Field of the Invention

The invention relates to a toilet tank handle assembly and, more particularly, to a toilet tank handle assembly common to various toilet tanks for quick assembly.

b) Description of Prior Art

As shown in FIG. 1, it is a conventional toilet tank handle assembly 1, which is consisted of a connecting rod 11, an internal fixed base 12, a washer 13, an external fixed base 14, a mandrel 15 and a handle 16, the connecting rod 11 includes a rotating shaft 111 and an arm 113, a ratchet teeth 112 is set on an end of the rotating shaft 111, the internal fixed base 12 is fastened to the external fixed base 14 for fixing the whole handle assembly 1 to a toilet tank (it is conventional structure, not shown in figure), an inner ratchet hole 161 is set on the handle 16 for the ratchet teeth 112 of the rotating shaft 111 being embedded in. There are some troubles with the assembly of his kind of conventional handle assembly 1, especially for installation of the connecting rod 11, it is because the angle is not definite and the division of the embedded angle of the internal ratchet hole 161 and the ratchet teeth 112 is too small, so that users cannot perceive the assembly angle and it causes the angle is too high or too low after assembly, it takes a lot of time in assembly and adjustment process.

Besides, referring to the structure of current toilet tank handle assembly and cited references U.S. Pat. No. 9,469,980 B2, WO 2017/007540A1, the inventor found that the installation location of existing toilet tank handles are various, some are on the front left side of toilet tank, some are on the front right side, some are further on the lateral side of the toilet tank. There are more than three styles just according to different installation locations of handles, and they could not be used in common between each other, it is also be widely criticized by users.

SUMMARY OF THE INVENTION

In view of this, the inventor provides a toilet tank handle assembly of the present invention after numerous improvements, namely, the object of the invention is to provide a toilet tank handle assembly common to various toilet tanks for quick assembly, to thereby improve the drawbacks of inconvenience in assembly and wasting time to adjust installation angle.

To achieve the object of the present invention, the toilet tank handle assembly of the present invention includes:

a connecting rod group, a head stock is set on it, a hexagon hole and multiple elastic pieces are set on the head stock, stoppers are respectively set on the inner sides of the elastic piece, an arm is extendedly set on a side of the head stock;

a shaft, an inserting portion is set on its one end, a hexagon connecting portion and a groove are set on another end of the shaft, the hexagon connecting portion is provided to insert into the hexagon hole, the stoppers are provided to buckle the groove;

an internal fixed base, a second internal screw hole is set on it;

an external fixed base, a second through hole and a second thread section are set on it, the second thread section is set on the second internal screw hole for the internal fixed base and the external fixed base to fix to internal and external walls of a toilet tank correspondingly;

a handle, a shaft tube is set on its one side, an internal hole is set on the shaft tube for the inserting portion of the shaft to insert.

The above head stock, a first connecting terminal is set on its one side, a first internal screw hole, a first ratchet tooth surface and a second ratchet tooth surface are set on the first connecting terminal, the first ratchet tooth surface and the second ratchet tooth surface are respectively installed on relative positions of two sides of the first connecting terminal.

The above arm, a second connecting terminal is set on an end, a first through hole and a third ratchet tooth surface are set on the second connecting terminal, and the first through hole is provided for a wing bolt to fasten on it.

The above arm is consisted of a bendable metal rod body.

DETAILED DESCRIPTION OF THE INVENTION

Figure 1:
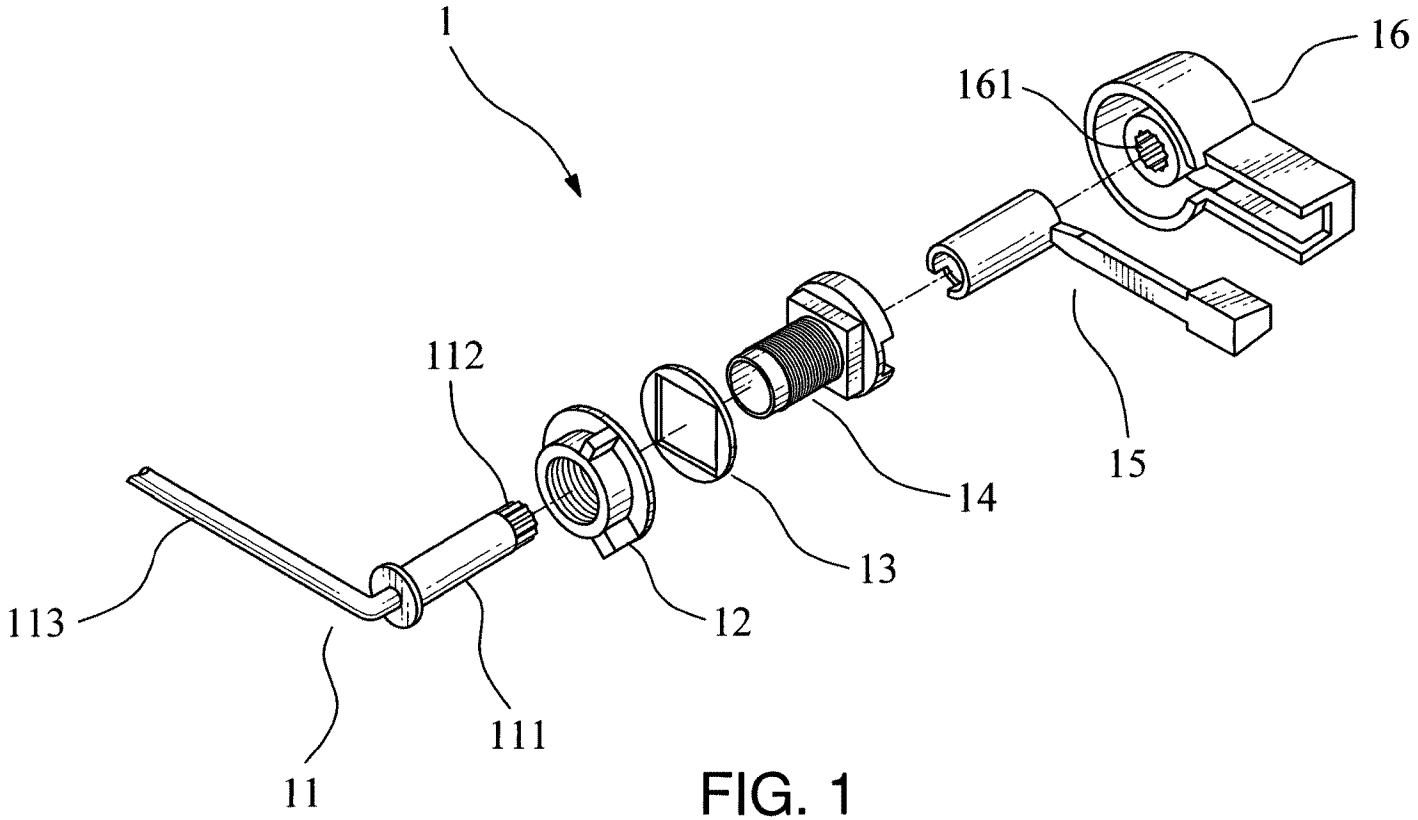
FIG. 1 PRIOR ART
FIG. 1 is a three-dimensional exploded diagram of a conventional toilet tank handle assembly.
Figure 2:
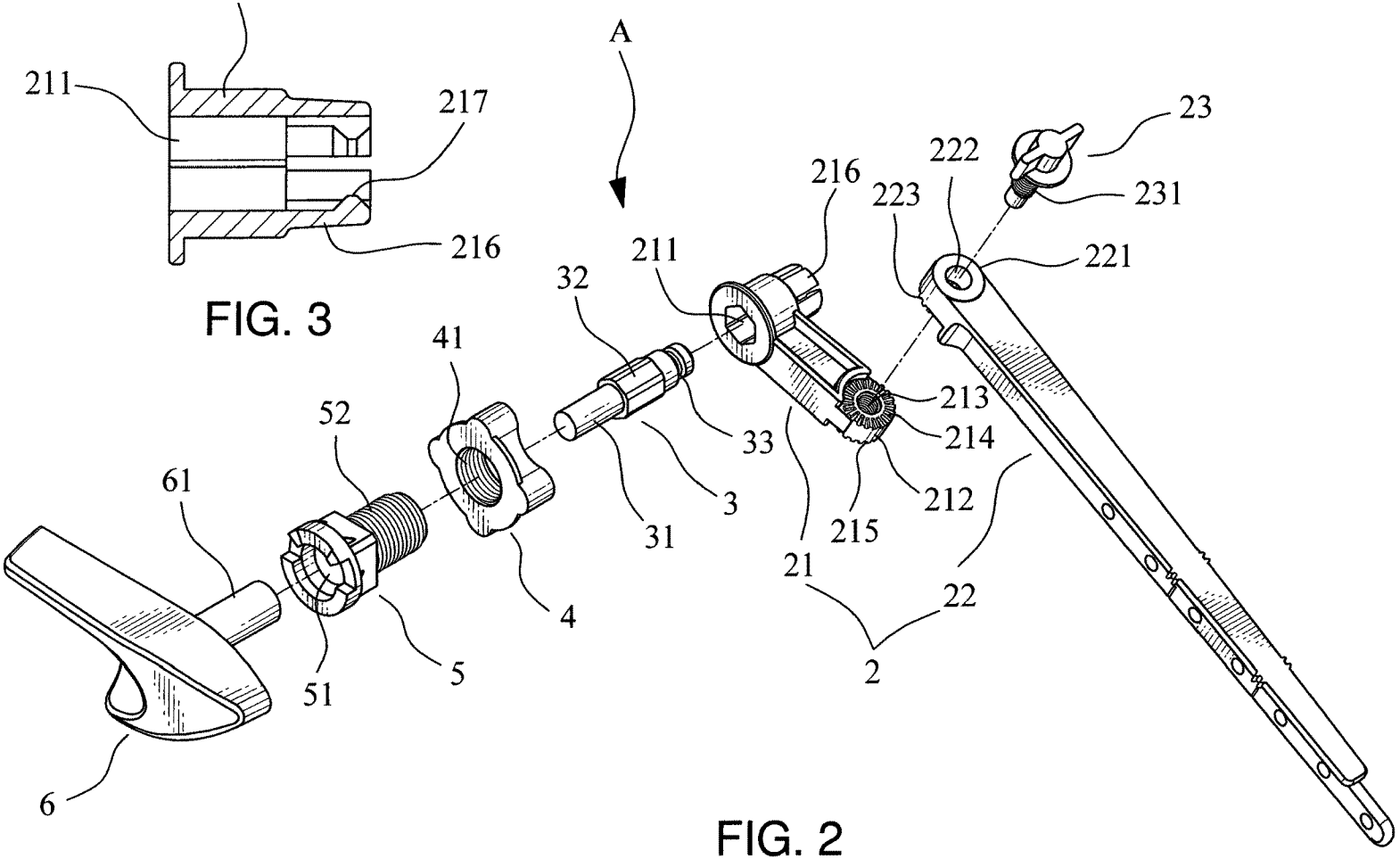
FIG. 2 is a three-dimensional exploded diagram of the present invention.
Figure 3:
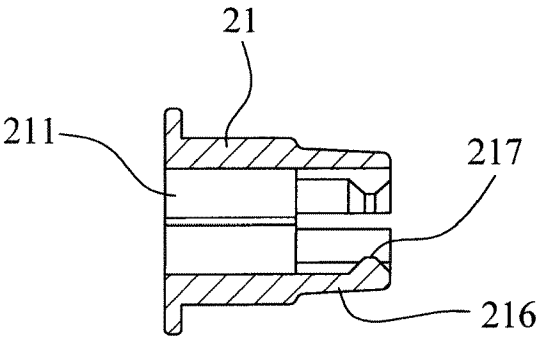
FIG. 3 is a cross-sectional schematic diagram of the head stock of the connecting rod group of the present invention.
Figure 5:
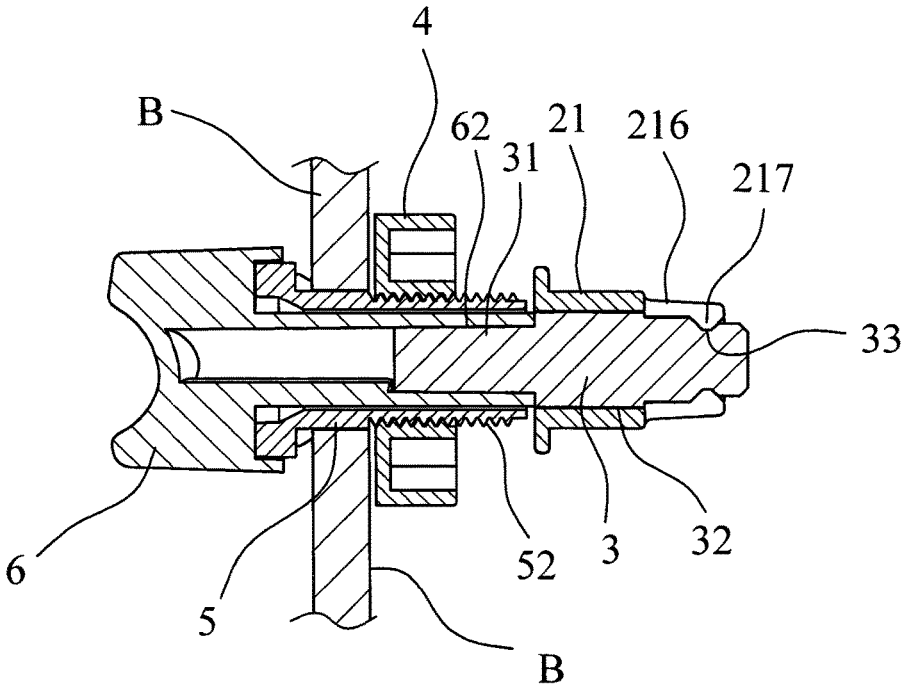
FIG. 5 is a partial cross-sectional schematic diagram of the assembly of the present invention.

Please refer to FIG. 2, FIG. 3, FIG. 5, the toilet tank handle assembly A of the present invention includes:

a connecting rod group 2, a head stock 21 is set on it, a hexagon hole 211 and multiple elastic pieces 216 are set on the head stock 21, stoppers 217 are respectively set on the inner sides of the elastic piece 216, a first connecting terminal 212 is set on a side of the head stock 21, a first internal screw hole 213, a first ratchet tooth surface 21 and a second ratchet tooth surface 215 are set on the first connecting terminal 212, the first ratchet tooth surface 214 and the second ratchet tooth surface 215 are respectively installed on relative positions of two sides of the first connecting terminal 212, an arm 22 is further extendedly set on the first connecting terminal 212, a second connecting terminal 221 is set on an end of the arm 22, a first through hole 222 and a third ratchet tooth surface 223 are set on the second connecting terminal 221, the first through hole 222 corresponded to the first internal screw hole 213 is provided for a first thread section 231 of a wing bolt 23 to fasten on it;

a shaft 3, an inserting portion 31 is set on its one end, a hexagon connecting portion 32 and a groove 33 are set on another end of the shaft 3, the hexagon connecting portion 32 is provided to insert into the hexagon hole 211, the stoppers 217 are provided to buckle the groove 33;

an internal fixed base 4, a second internal screw hole 41 is set on it;

an external fixed base 5, a second through hole 51 and a second thread section 52 are set on it, the second thread section 52 is set on the second internal screw hole 41 for the internal fixed base 4 and the external fixed base 5 to fix to internal and external walls of a toilet tank B correspondingly;

a handle 6, a shaft tube 61 is set on its one side, an internal hole 62 is set on the shaft tube 61 for the inserting portion of the shaft 3 to insert.

Figure 4:
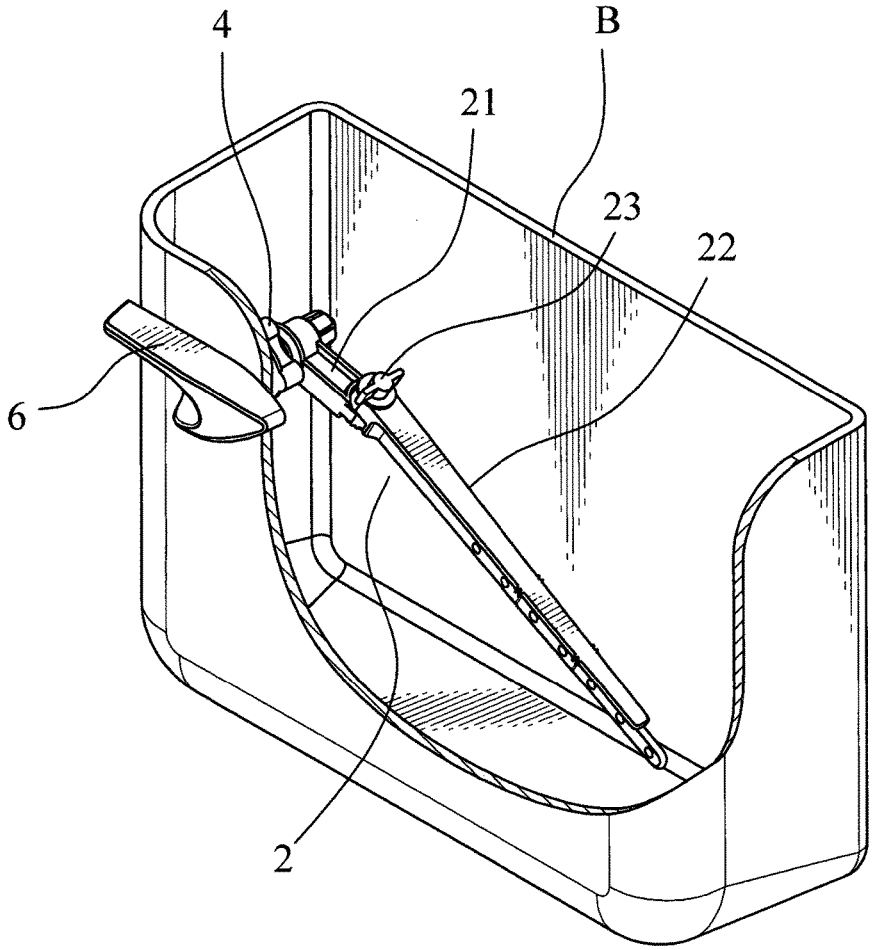
FIG. 4 is a schematic diagram of embodiment (1) of the present invention.

By the above composition, the present invention is common to various toilet tank B. At assembly time, it could be installed according to the location of the handle assembly A of the toilet tank B, as shown in FIG. 4, which is the embodiment of installing the handle assembly A on the front left side of the toilet tank B. At assembly time, the internal fixed base 4 is provided to fasten to the external fixed base 5, to fix the whole handle assembly A to the toilet tank B, the inserting portion 31 of the shaft 3 is inserted into the internal hole 62 of the shaft tube 61 of the handle 6, the hexagon connecting portion 32 of the shaft 3 is inserted into the hexagon hole 211, the stopper 217 is buckled the groove 33 (please refer to FIG. 5 at the same time), then the embedded position of the third ratchet tooth surface 223 and the first ratchet tooth surface 214 has to be adjusted to let the angle of the arm 22 of the connecting rod group 2 meet use requirements, and finally, the wing bolt 23 is provided to fasten.

Figure 6:
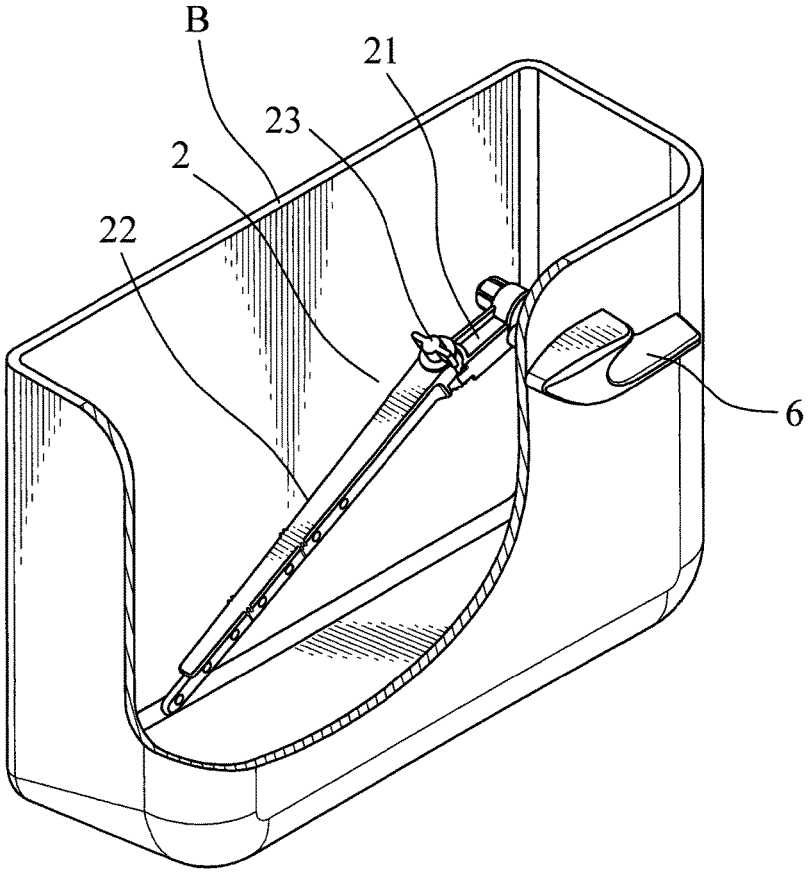
FIG. 6 is a schematic diagram of embodiment (2) of the present invention.

As shown in FIG. 6, it is the embodiment of setting the handle assembly A on the front right side of the toilet tank B. At assembly time, the internal fixed base 4 is provided to fasten to the external fixed base 5, to fix the whole handle assembly A to the toilet tank B, the inserting portion 31 of the shaft 3 is inserted into the internal hole 62 of the shaft tube 61 of the handle 6, the hexagon connecting portion 32 of the shaft 3 is inserted into the hexagon hole 211, the stopper 217 is buckled the groove 33 (please refer to FIG. 5 at the same time), then the arm 22 would be changed direction to let the second ratchet tooth surface 215 be embedded with the third ratchet tooth surface 223, and the embedded position has to be adjusted to let the angle of the arm 22 of the connecting to rod group 2 meet use requirements, and finally, the wing bolt 23 is provided to fasten.

Figure 7:
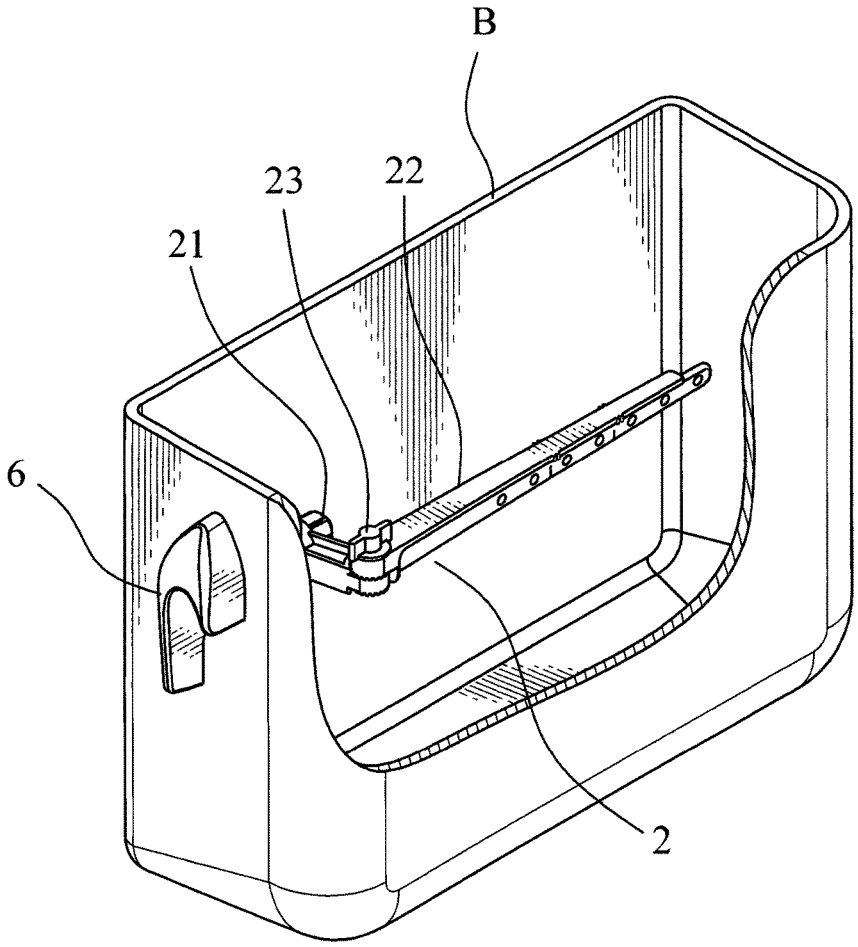
FIG. 7 is a schematic diagram of embodiment (3) of the present invention.

FIG. 7 shows the embodiment of installing the handle assembly A on the lateral side of the toilet tank B. At assembly time, the internal fixed base 4 is provided to fasten to the external fixed base 5, to fix the whole handle assembly A to the toilet tank B, the inserting portion 31 of the shaft 3 is inserted into the internal hole 62 of the shaft tube 61 of the handle 6, the hexagon connecting portion 32 of the shaft 3 is inserted into the hexagon hole 211, the stopper 217 is buckled the groove 33 (please refer to FIG. 5 at the same time), then the embedded position of the third ratchet tooth surface 223 and the first ratchet tooth surface 214 has to be adjusted to let the angle of the arm 22 of the connecting rod group 2 meet use requirements, and finally, the wing bolt 23 is provided to fasten.

Figure 8:
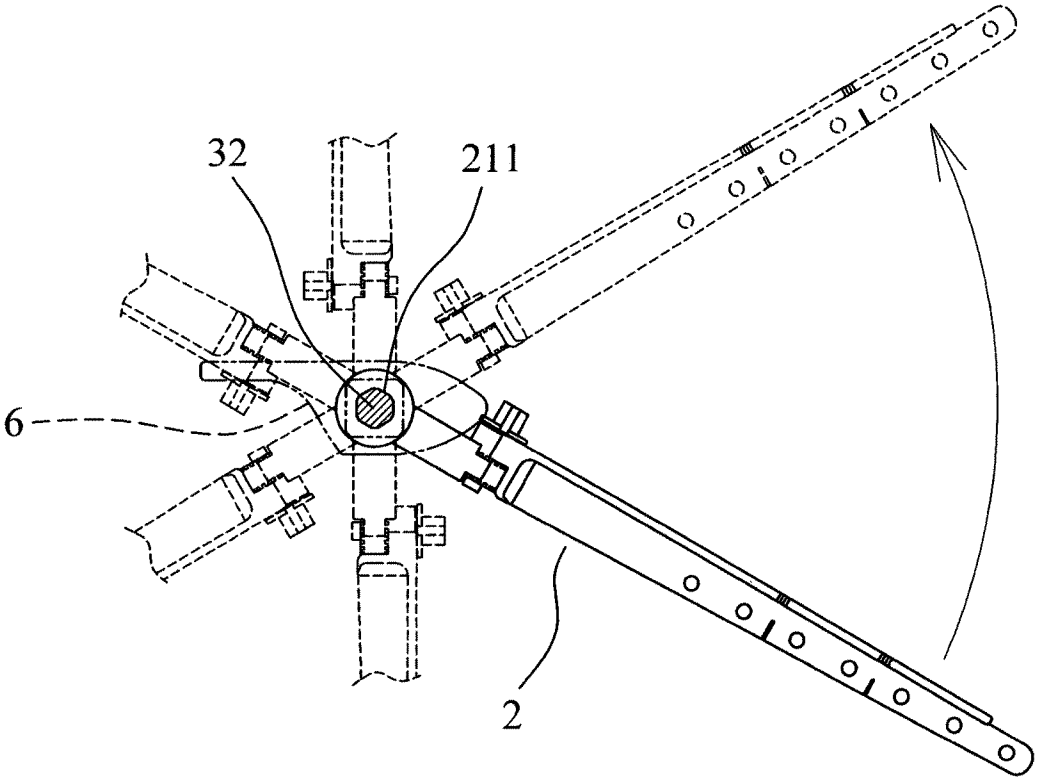
FIG. 8 is a schematic diagram of angle of the assembly of the present invention.

The present invention could be common for installing the handle assembly A of various toilet tanks S, especially the hexagon connecting portion 32 of the shaft 3 of the present invention is designed as hexagonal cylinder for the hexagon hole 211 of the head stock 21, which is provided to meet the installation angle of various toilet tank (as shown in FIG. 8), and the stopper 217 is provided to buckle the groove 33 for positioning, to thereby achieve quick installation convenience. For a common toilet tank, whatever the handle is set on left or right side, normal or oblique installation, horizontal or downwards 30 degrees may be used as the range of its used angle. The hexagon connection portion 32 of the present invention designed as a hexagonal cylinder uses a downward angle of 30 degrees, the hexagon connecting portion 32 could be within the range of this angle when the handle is pressed in the left or right side. Also, arm of force of the installed arm 22 is long, so it is effortless to flush. In addition, users only need to adjust the installation angle of the hexagon connecting portion 32 to 90 degrees for the handle installed on the lateral side of the toilet tank B, but arm of force of the arm 22 may become shorter in this way, so a larger pressing angle is needed to provide an enough distance for the flapper to rise up, at this moment, the handle could be installed vertically to let the pendant angle of the arm 22 be 60 degrees with the level so as to meet installation and use requirements. Therefore, the present invention may be common to the handle assembly A of various toilet tanks B.

Figure 9:
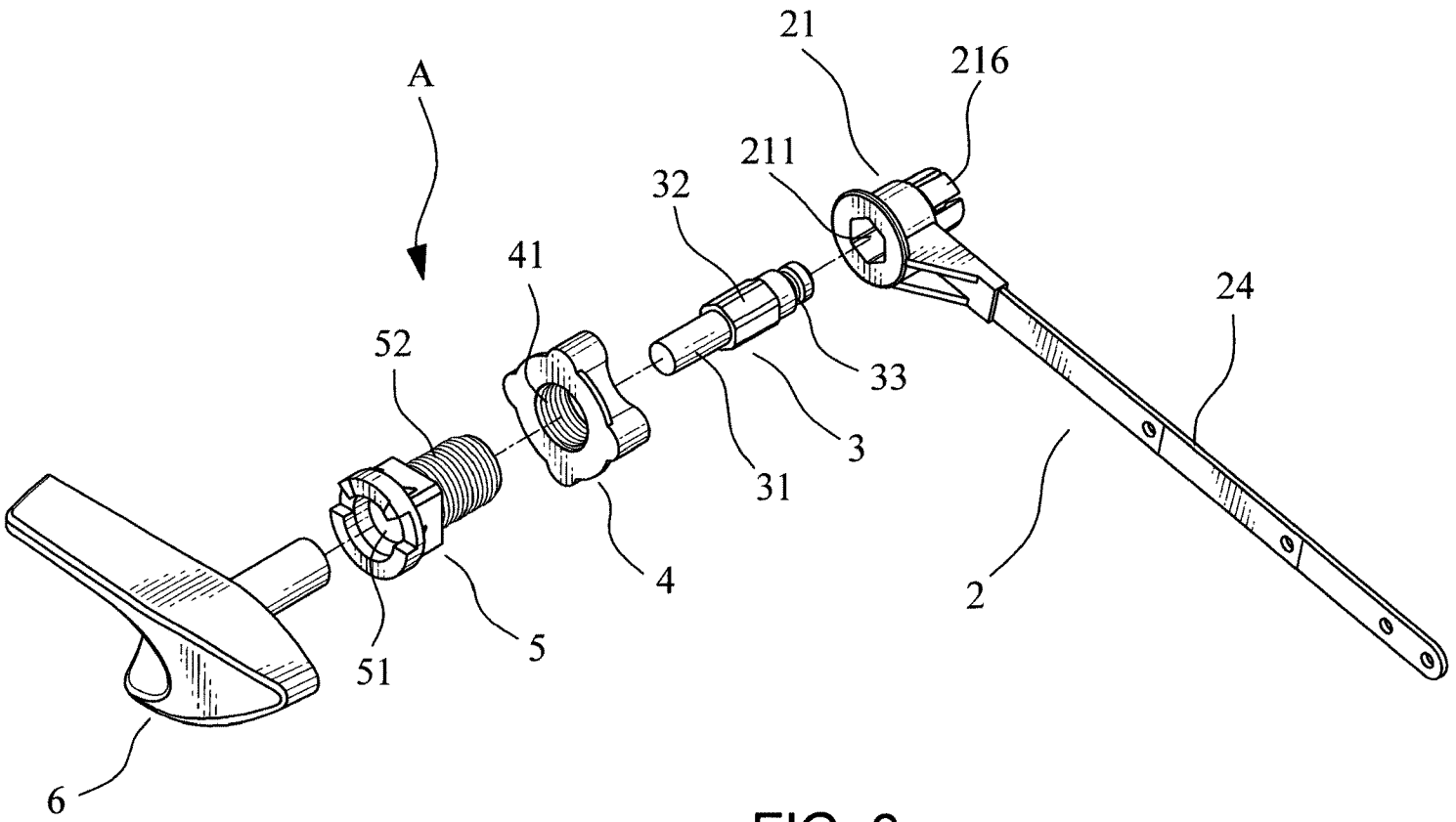
FIG. 9 is a three-dimensional exploded diagram of another embodiment of the connecting rod group of the present invention.
Figure 10:
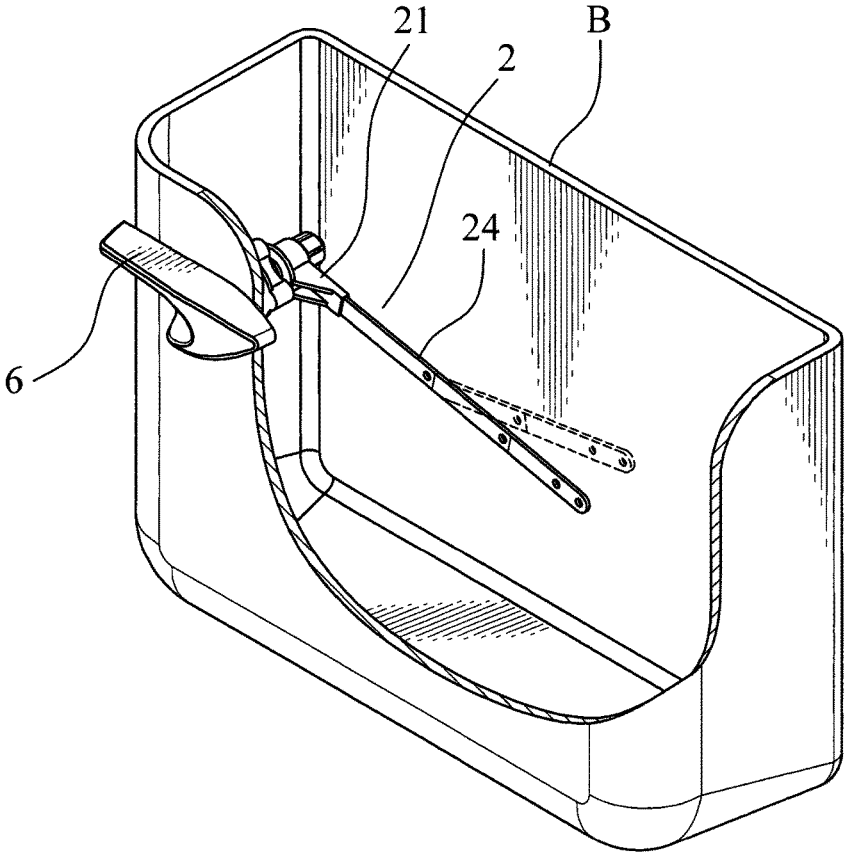
FIG. 10 is a schematic diagram of embodiment (4) of the present invention.

FIG. 9 shows another embodiment of the connecting rod group 2 of the present invention, wherein the connecting rod group 2 is consisted of a head stock 21 and an arm 24, the arm 24 is consisted of a bendable metal rod body, so the arm 24 could be bent to meet use requirements to install for the handle assembly A of various toilet tank B.

What is claimed is:

1. A toilet tank handle assembly, including:

a connecting rod group having a head stock, a hexagon hole and multiple elastic pieces are set on the head stock, stoppers are respectively set on an interior of each of the multiple elastic pieces, an arm is extendedly set on a side of the head stock;

a shaft, an inserting portion is set on a first end of the shaft, a hexagon connecting portion and a groove are set on a second end of the shaft, the hexagon connecting portion is provided to insert into the hexagon hole, the stoppers of the multiple elastic pieces are inserted into the groove located in the second end of the shaft;

an internal fixed base, a second internal screw hole is set on the internal fixed base;

an external fixed base, a second through hole and a second thread section are set on the external fixed base, the second thread section is set on the second internal screw hole for the internal fixed base and the external fixed base to fix to internal and external walls of a toilet tank correspondingly;

a handle, a shaft tube is set on a side of the handle, an internal hole is set on the shaft tube for the inserting portion of the shaft to insert;

wherein the shaft tube of the handle is inserted through the external fixed base and the internal fixed base, and the inserting portion of the shaft is inserted into the shaft tube of the handle, a portion of the inserting portion of the shaft is located within the shaft tube of the handle, the external fixed base, and the internal fixed base.

2. The toilet tank handle assembly as claimed in claim 1, wherein a first connecting terminal is set on a side of the head stock, a first internal screw hole, a first ratchet tooth surface and a second ratchet tooth surface are set on the first connecting terminal, the first ratchet tooth surface and the second ratchet tooth surface are respectively installed on relative positions of two sides of the first connecting terminal.

3. The toilet tank handle assembly as claimed in claim 2, wherein a second connecting terminal is set on the arm, a first through hole and a third ratchet tooth surface are set on the second connecting terminal, and the first through hole is provided for a wing bolt to fasten thereon.

4. The toilet tank handle assembly as claimed in claim 1, wherein the arm is consisted of a bendable metal rod body.

* * * * *